United States Patent [19]

Baugh

[11] Patent Number: 4,492,359

[45] Date of Patent: Jan. 8, 1985

[54] VALVE ASSEMBLY

[76] Inventor: Benton F. Baugh, 14626 Oak Bend, Houston, Tex. 77079

[21] Appl. No.: 392,277

[22] Filed: Jun. 25, 1982

[51] Int. Cl.[3] ..... E21B 33/06

[52] U.S. Cl. ..... 251/1 A; 92/110; 92/117 R; 92/146

[58] Field of Search ..... 251/1 A, 1 B, 1 R; 92/117 R, 110, 146

[56] References Cited

U.S. PATENT DOCUMENTS

| | | | |
|---|---|---|---|
| 3,208,357 | 9/1965 | Allen et al. | 92/117 R |
| 3,272,222 | 9/1966 | Allen | 251/1 A |
| 4,178,838 | 12/1979 | Stafford | 92/117 A |
| 4,437,643 | 3/1984 | Brakhage, Jr. et al. | 251/1 A |

*Primary Examiner*—A. Michael Chambers
*Assistant Examiner*—Sheri Novack
*Attorney, Agent, or Firm*—Carwell & Helmreich

[57] ABSTRACT

A ram-type valve assembly for well blowout prevention applications and the like. Opposing ram assemblies disposed in ram guideways transverse to the valve bore are each provided with two pistons extending outward of the valve housing having internal passages communicating with respective passages internal of the housing terminating in respective closing and opening ports. A cylinder assembly with interconnected cylindrical chambers is slidably disposed about respective pistons. Pressurizing the closing or opening ports transmits pressure through the pistons to the chambers, effecting cylinder assembly movement along the pistons inward toward and outward from the bore, respectively. Each cylinder assembly is interconnected to its respective ram, transmitting cylinder movement to the ram. The hydraulic circuits are isolated from the bore preventing hydraulic circuit contamination and accidental ram opening from bore pressure leaks into the hydraulics. Cylinder stroke is longer than that of the ram in normal opening and closing operation, such that removal of bonnet bolts permits further outward travel of the cylinders, moving the ram out of the ram guideway for servicing or changing.

13 Claims, 6 Drawing Figures

VALVE ASSEMBLY

BACKGROUND OF THE INVENTION

Ram type valve assemblies have long been known for effectively sealing off fluid flow through the valve bore. Illustrative of these types of valves, are the ones depicted, for example, in Volume 1, pages 1288–1289, of the "Composite Catalog of Oilfield Equipment and Services", 33rd Revision, 1978–79, published by World Oil. In that the teachings and improvements of the present invention are particularly adaptable to the types of valve apparatus therein depicted and described, such disclosure thereof is accordingly herein incorporated by reference with respect to the overall general construction and operation of such ram-type valve assemblies.

Such valve assemblies are typically provided with two piston-like rams disposed in opposed relation, and means for moving the rams transversely to the valve bore. Upon inward movement of the rams into the bore, sealing engagement is thereby effected between seals carried on the ends of the rams proximal to the bore, thus effectively terminating fluid flow therethrough.

Means for effecting said movement of each of the rams frequently comprises a hydraulically actuated cylinder having a piston interconnected to the respective ram by a shaft or a "stem". The stem is variously provided with stem packings or seals disposed about the stem to prevent pressure and fluid in the valve bore from being communicated along the stem and into the hydraulic circuit of the cylinder. However, not infrequently these seals would fail due to wear, improper seating, excessive borehole pressure, or the like, resulting in contamination of the aforementioned hydraulic circuit with borehole fluid.

Even more serious, however, it was found that such leakage could, in some instances, serve as hydraulic fluid, actuating the cylinders and forcing the pistons thereof radially outward of the bore. This, in turn, would pull the rams apart, thus breaking the aforementioned sealing of the rams, whereby the bore was no longer sealed off, further resulting in loss of control of the flow through the bore and, in some instances, for example, loss of control over the well.

One attempted solution has been to provide secondary manually energized seals which are energized with plastic packing through small check valves. This may be seen on page 1289 of the aforementioned composite catalog and is well known in the art.

Although this attempt to provide redundant sealing along the stem has met with relative success, it was found to be unsatisfactory in some respects for several reasons, only one of which being that the seals will, in time, begin to leak if not properly maintained. Thus, it remained extremely desirable to find a means for completely and reliably isolating the valve bore from the hydraulic circuit of the operating cylinders.

Each ram assembly in the ram-type valve apparatus of the prior art was further typically provided with a pair of pistons rigidly affixed at one end to the valve housing and extending outward in the same general direction as and on either side of a respective ram stem. A conventional bonnet was further provided having two cylinders each disposed about its respective piston, the aforesaid bonnet being rigidly affixed to the valve housing in like manner to the pistons, by means of bonnet bolts. This combination of the bonnet and pistons was interconnected to the hydraulic circuit of the operating cylinder, whereby, upon removal of the bonnet bolts and further charging of an appropriate port of the hydraulic circuit, the bonnet may thereby be made to travel radially inward and outward of the bore in like manner to the operating cylinder. The operating piston was typically retained in the aforementioned operating cylinder which formed a part of the bonnet, and the operating piston was interconnected to the ram by the hereinabove noted stem. It will thus be appreciated that the aforesaid outward movement of the bonnet, which was no longer restrained by the bonnet bolts, would continue further out, thereby pulling the ram along ram guideways outwards of the bore and further than its normal inward and outward operating stroke, so as to render the ram accessable for servicing, such as changing the inner seals, and the like.

However, it will be readily apparent that, in addition to the hereinabove noted sealing problem, yet another drawback of the designs of the prior art was that each ram required three cylinders and pistons. It would thus be highly desirable to reduce the number of cylinders required not only in the moving of the ram assemblies inward and outward of the bore during normal sealing operation, but in the aforementioned hydraulic movement of the ram assemblies further outward of the housing for purposes of servicing the ram assemblies.

The disadvantages of the prior art including those hereinabove recited are overcome by the ram-type valve assembly of the present invention.

SUMMARY OF THE INVENTION

This invention relates to a valve apparatus of the ram type. In but one of its aspects, it relates more particularly to such apparatus having hydraulically controllable cylinders adapted for actuating the rams, for use in a blowout preventer or the like.

In a preferred embodiment, the apparatus of the present invention includes a housing having a vertical bore therethrough and two apertures disposed in opposed relation through the housing wall transverse to the bore. An intermediate flange is mounted on the outer wall about each aperture by a plurality of bonnet bolts extending through the flanges and into threaded portions of the wall. Each flange has a recess which, in alignmnet with its respective aperture extending through the housing wall, forms a cylindrical ram guideway for slidably receiving a ram and a resilient inner seal disposed therein proximal to the bore.

Two holes on either side of each ram guideway extend horizontally through their respective flange and terminate in threaded portions in the housing. A pair of cylindrical pistons extend horizontally in parallel fashion outward of the flange, each such piston having an end portion received by its aforementioned respective hole and threaded into the threaded portion of said hole. A cylinder is sealingly disposed about the outer portion of each piston distal to the threaded end portion, each such cylinder being rigidly interconnected to its corresponding cylinder of the other piston on the same side of the bore, whereby both cylinders may move horizontally in parallel and in concert along their respective pistons. A rigid stem extends through a hole in the flange and interconnects its respective ram and cylinder pair at the proximal and distal ends thereof, such that the aforementioned movement of the cylinder pair is transmitted through the stem to the ram.

Each piston is comprised of a shaft portion and a head disposed at the distal end thereof having a crosssectional diameter approximating the inside diameter of its corresponding cylinder, whereby, when the head is located intermdiate of the proximal and distal ends of the cylinder, two sealed chambers are thereby formed. A plate interconnecting the distal ends of the two cylinders of each cylinder assembly is provided with a passageway whereby the distal chambers of each cylinder are interconnected. In like manner, each pair of cylinders is further provided with a plate disposed at the proximal ends of the cylinders having a passageway interconnecting the proximal chambers of the cylinder pair.

With respect to each piston pair, each piston is provided with an internal piston passage extending along the length of the piston to the threaded end portion thereof which is matingly received by the housing. Each piston is further provided with a housing fluid passage internal of the housing wall interconnecting its respective piston passage to a port on the outer wall of the housing. With respect to each piston pair, the piston passage of one such piston extends internal of the piston through its entire length including the head whereby a hydraulic circuit is formed permitting the passage of hydraulic fluid from each distal cylinder chamber (interconnected by its respective passage in the interconnecting plate) through the piston passage, the housing fluid passage, to the port on the wall, and vice-versa.

The piston passage of the other piston of the piston pair, in like manner, extends coaxially along the length of the piston but terminates prior to extending through the head of the piston. Moreover, this piston passage is interconnected to the proximal chamber of its respective cylinder by means of a transverse piston passage extending transversely to the axis of the piston and interconnecting the aforesaid piston passage and the proximal cylinder chamber. Thus, a second hydraulic circuit is thereby formed whereby hydraulic fluid may be communicated from the proximal chambers of the cylinder pair (interconnected by the aforementioned transverse passage extending through the proximal plate interconnecting the two cylinders) through the transverse piston passage, along the longitudinal piston passage, through the respective housing fluid passage, and to its respective port on the housing wall, and vice-versa.

Thus, by hydraulically charging the open port associated with the piston having the piston passage extending entirely therethrough, the distal chambers of the cylinder pair are thereby charged moving the cylinder assembly associated with the particular ram radially outward from the bore which, as hereinbefore described, in turn pulls the ram associated therewith radially outward of the bore. The fluid trapped in the proximal chambers of the cylinder pair, as the chambers decrease in size due to the cylinder movement, is thereby ported through the transverse piston passage of the other piston, down the piston passage and associated housing fluid passage, and outward through the corresponding port.

In reverse operation, by charging the close port, the proximal chambers of the particular cylinder assembly may thereby be charged, forcing the cylinder pair radially inwards toward the bore, thus pushing the ram, in like manner, radially inward of the bore so as to effect sealing engagement with the corresponding and oppositely disposed ram within the bore. Hydraulic fluid trapped in the distal chambers is communicated through the passage of the piston having such a passage extending entirely through the length thereof, through the respective housing fluid passage, and port.

The stroke of the cylinder pair is longer than that of the ram during normal opening and closing operations of the bore. During the normal opening operation, the ram disposed in the ram guideway abuttingly engages and is thereby stopped by the intermediate flange during its movement radially outward of the bore due to the aforementioned fastening of the flange to the housing by means of the bonnet bolts. However, upon removal of the bonnet bolts, the continued further stroke of the cylinder assembly interconnected to the ram by means of the rigid stem will cause continued outward movement of the ram which is no longer constrained by the intermediate flange. Thus, the ram will continue movement radially outward from the bore, carrying the intermediate flange with it as the flange slides along the piston pair extending therethrough until such time as the stroke of the cylinder is completed or the flange abuttingly engages the proximal ends of the cylinder pair, whichever occurs first. The ram is thus extracted outwards of the housing, and, due to the flange movement, is thereby exposed outward of the housing for servicing such as seal changes, for ram changes, or the like. The aforementioned hydraulic circuits are beneficially isolated from pressure and fluid within the bore, whereby any fluid passing from the bore around the ram and ram stem seals and between the ram stem and the hole in the flange through which the stem extends is thereby permitted to the ambient rather than being vented to enter the hydraulic circuits, contaminating same, and, in some instances, causing accidental operation thereof.

It is an object of this invention to provide a new and improved valve apparatus of the ram-type.

It is another object of the present invention to provide such a valve apparatus having a new and improved means for actuating the rams.

A further object of this invention is to provide for new and improved hydraulic means for actuating rams, whereby the hydraulic circuits thereof are isolated from the valve bore.

Yet another object of the present invention is to provide a means for performing the combined functions of actuating the rams of a blowout preventer during normal opening and closing operation as well as for effecting accessibility of the rams for servicing or the like outward of the ram housing.

It is still a further object of the present invention to provide a hydraulically actuated piston pair for both effecting the opening and closing off of the bore of a blowout preventer by rams as well as for extracting the rams from the preventer housing.

Yet another object of this invention is to provide a hydraulically actuated piston assembly having a first stroke adapted for moving oppositely disposed rams inward and outward of the bore of a blowout preventer during normal operation and an extension of said stroke for further moving the ram outward of the preventer housing with the intermediate flange associated with the piston assembly for providing easy accessability to the ram outside the preventer body.

BRIEF DESCRIPTION OF THE DRAWINGS

These and other objects and advantages are hereinafter set forth in greater detail with reference to the drawings, wherein.

DESCRIPTION OF THE PREFERRED EMBODIMENT

Figure 1:
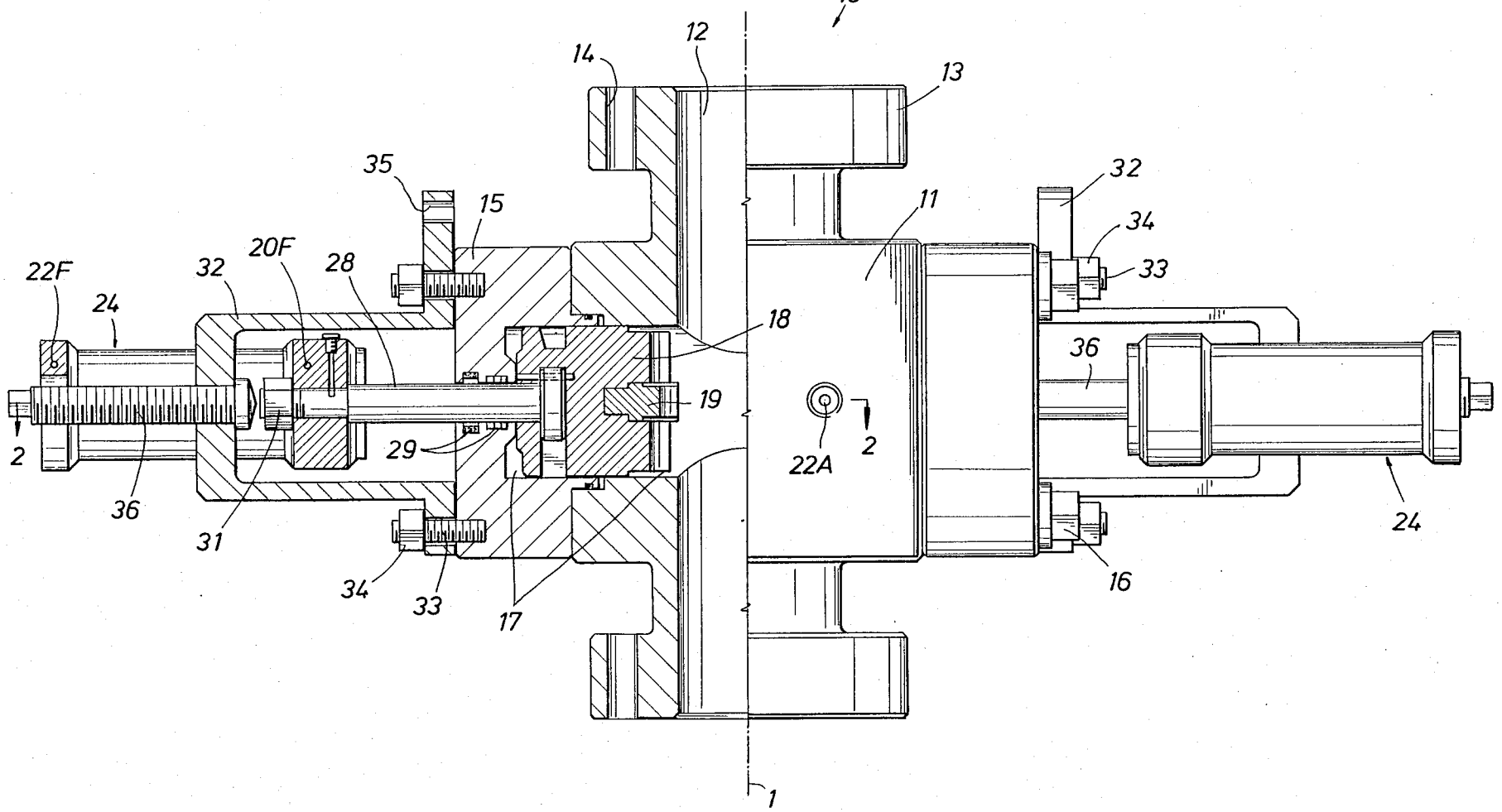
FIG. 1 is an elevation view of a valve apparatus construction in accordance with a preferred form of the present invention with the left hand portion shown in section.

Referring first to FIG. 1, a valve assembly 10 of the present invention is therein depicted having a valve body or housing 11 preferably of forged steel, and a central bore 12 therethrough disposed along a bore center line 1, and flanges 13 at both ends of housing 11 suitable for interconnection with pipe, tubing, or the like by means of bolts (not shown) extending through flange bolt holes 14. Alternatively, standard threaded connections may of course be provided in lieu of the flanges 13.

In the description which follows, it will be appreciated that the apparatus depicted to the left of the bore center line 1 is generally identical and symmetric with that shown to the right of the bore center line 1. Accordingly, for purposes of simplicity, description of the left most portion of the valve assembly 10 is applicable in like manner to that of the non-sectioned right hand portion of FIG. 1 which will not be described.

Still referring to FIG. 1, an intermediate flange 15 is provided which is attached to the outer wall of housing 11 by means of a plurality of intermediate flange or bonnet bolts 16 extending through the flange 15 and into threaded portions of the outer wall of housing 11. A cylinderical recess is provided internal of the flange 15 which is matingly aligned with an aperture extending transversely to the housing 11 through the wall thereof, whereby the recess of flange 15 in concert with said aperture, when the flange 15 is bolted to the housing 11, thus defines an inner ram guideway 17 of a generally cylinderical shape.

Disposed within each ram guideway 17 in matingly slidable engagement, is a generally cyinderical ram body 18 which carries in a recess in the end thereof proximal to the bore 12 a resilient inner seal 19. Upon inward movement of each oppositely disposed ram body 18, in a manner to be hereinafter described, the respective inner seals 19 of each ram body 18 will be moved radially inward of the bore 12 so as to effect sealing engagement within the bore with one another and around wire line or pipe, if any, disposed within the bore 12, whereby the bore 12 is effectively sealed off, thereby preventing fluid flow through the valve assembly 10.

Figure 2:
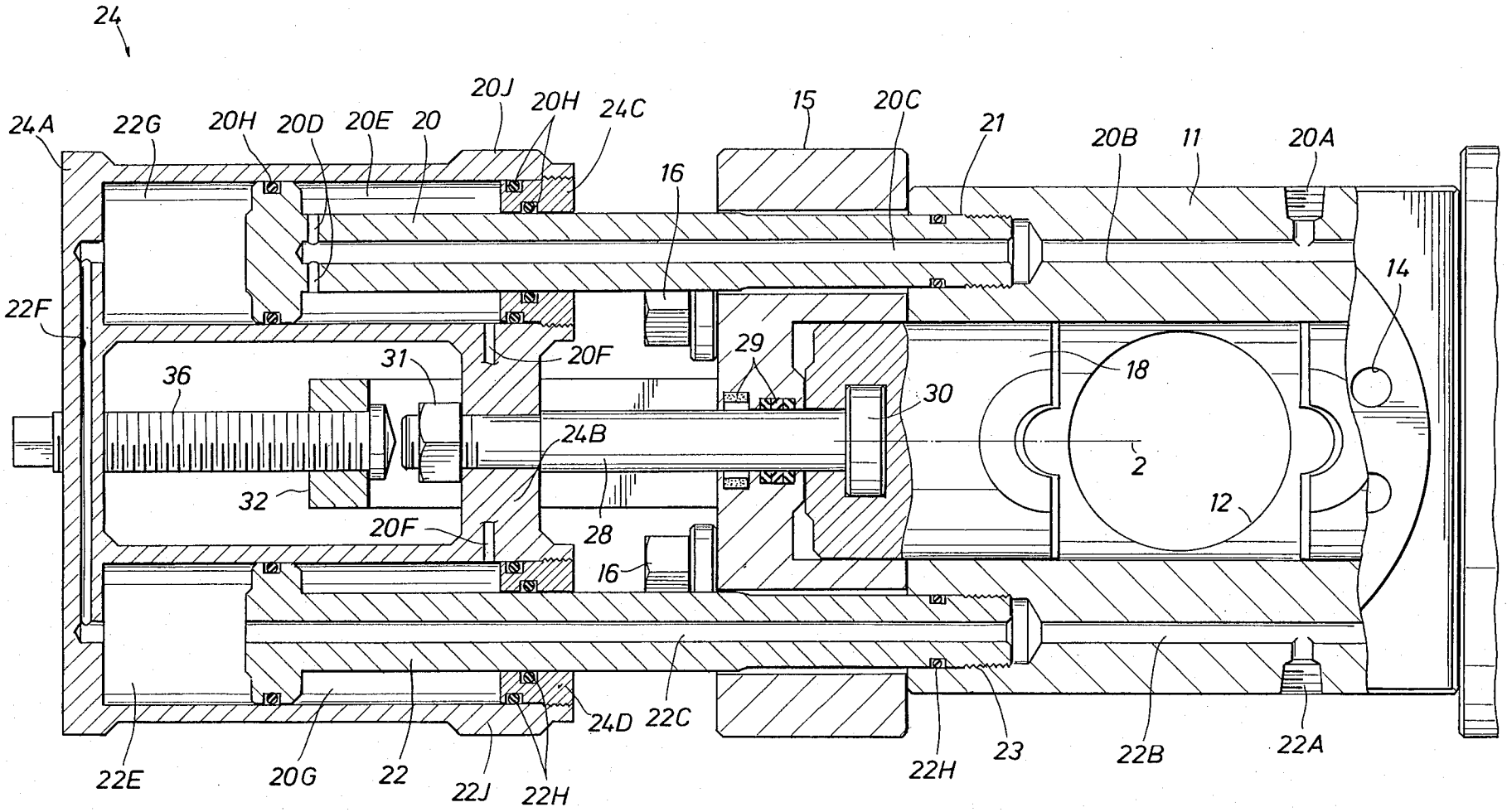
FIG. 2 is an enlarged scale plan view of the left hand portion of the valve apparatus of the present invention taken along the line 1—1 of FIG. 1, with the rams in an intermediate position.

Referring now briefly to FIG. 2, an elongate and generally cylinderically shaped ram close piston 20 may be seen disposed through a mating hole in intermediate flange 15 which is threaded at one end into a matingly threaded piston support aperture 21 in the outer wall of housing 11. Similarly, a ram open piston 22 is disposed through intermediate flange 15 and carried by piston support aperture in housing 11.

Figure 5:
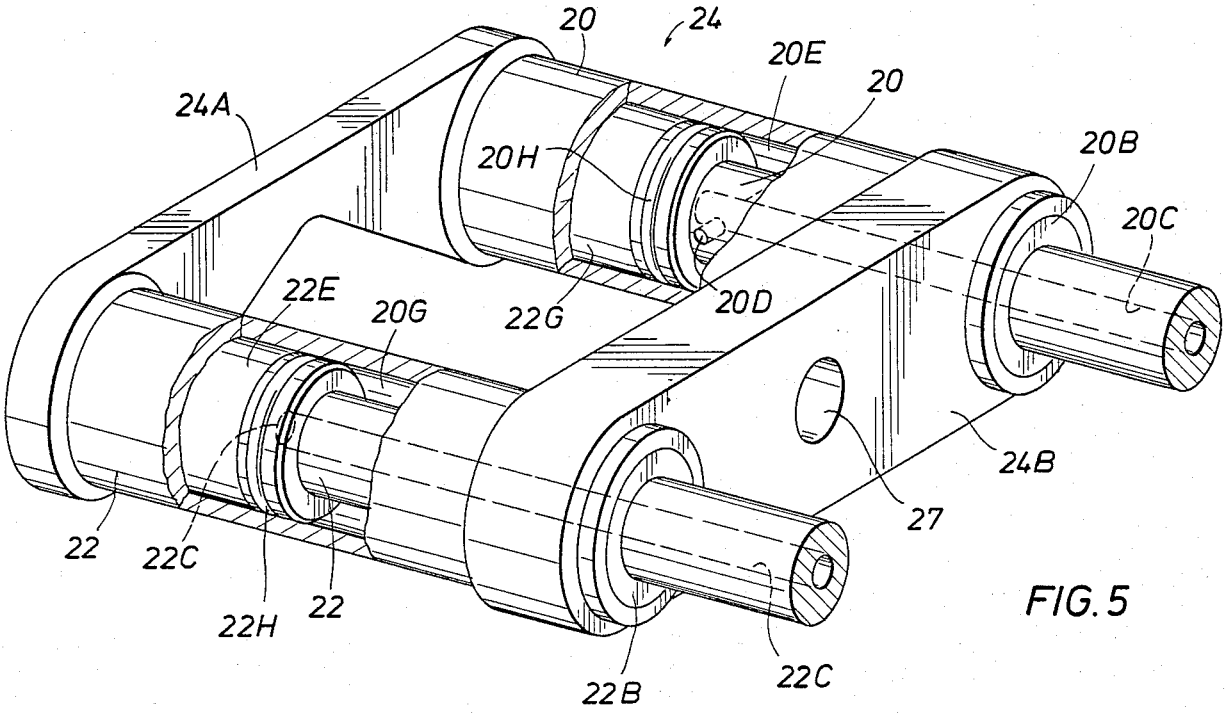
FIG. 5 is an isometric view of the cylinder assembly of the present invention.
Figure 6:
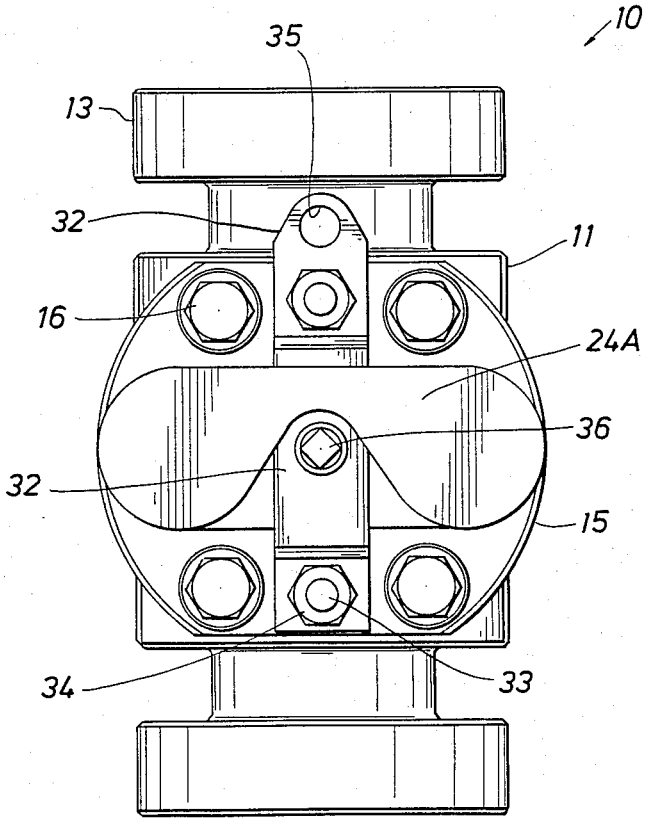
FIG. 6 is an end view of the valve apparatus of the present invention.

Still referring to FIG. 2, a "bonnet" or cylinder assembly 24, shown in isometric view in FIG. 5, defining two rigidly interconnected cylinderically shaped cavities in which are disposed end or piston head portions of the pistons 20 and 22, each cylinder forming its respective cavity being interconnected by means of inner and outer cylinder assembly plates 24A and 24B, respectively.

It will be seen in FIG. 5 that a main stem aperture 27 is provided through the inner cylinder assembly plate 24B. Referring back to FIG. 2, a main stem 28 is provided which is disposed through stem aperture 27 and affixed to plate 24B by means of a main stem nut 31. The proximal end of stem 28 extends through a mating aperture in intermediate flange 15 and terminates with a thrust nut 30 which is disposed within ram body 18. It may thereby be appreciated that due to the interconnection between ram body 18 and cylinder assembly 24 just described, movement of the cylinder assembly 24 by hydraulic actuation to be hereinafter described in more detail along ram close piston 20 and ram open piston 22 will cause correlative movement of ram body 18 inward and outward of the bore 12.

It is sometimes desirable to provide means for locking the rams of valve assembly 10 in a closed position without requiring continued hydraulic actuation of the hydraulic circuits, such as in applications wherein the valve assembly 10 will remain in a closed position for a substantial length of time. It is further frequently desirable to provide means for manual closing of the ram bodies 18 either to provide redundancy for the hydraulic system in emergency conditions during failure thereof or, as but another example, in instances wherein the valve assembly 10 is located in a remote location and a source of hydraulic pressure is not readily available.

Accordingly, referring again to FIG. 1, a locking stem support 32 is rigidly affixed to flange 15 by means of a plurality of locking stem support studs 33 and support nuts 34. A threaded hole is provided in the stem support 32 which threadedly receives a locking stem 36. At the distal ends of stem 36 a key is provided adapted to receive a handle (not shown), whereby upon manual rotation of the handle, stem 36 is moved inward so as to contact main stem 28 thereby moving main stem 28 and ram body 18 radially inward. In passing, it will be noted that a lifting eye 35 may be provided in each stem support 32 for purposes of ease of transportation of the valve assembly 10 and the like.

Referring again to FIGS. 2 and 5, the cylinder assembly 24 will be described in further detail. A cylinderically shaped close cylinder **20*j* and open cylinder 22*j* are rigidly interconnected by means of an outer cylinder assembly plate 24A disposed at the distal end of the cylinders 20*j* and 22*j*, and an inner cylinder assembly plate 24b disposed at the ends thereof proximal to the bore 12. Each cylinder 20j and 22j is provided with a respective close cylinder chamber plug 24c and open cylinder chamber plug 24d having apertures therethrough which slidably and sealingly receive the stem portions of respective pistons 20 and 22. It will be appreciated that when the piston heads of the respective pistons 20 and 22 are located intermediate of outer and inner plates 24a and 24b, respectively, the head of close piston 20 divides the inner chamber formed by the walls of close cylinder 20j, plate 24a, and chamber plug 24c into two discrete chambers, namely close piston chamber 22g and close piston chamber 20e**.

In like manner, when the head of open piston 22 is disposed intermediate of plate 24a and plate 24b, the piston head thereof divides the chamber formed by the walls of open cylinder 22a, plate 24a, and chamber plug 24d into two discrete chambers, namely open piston chamber 22e and open piston chamber 20g. Moreover, a close examination of FIG. 2 reveals that disposed internally of plate 24a is a transverse cylinder assembly passage 22f whereby close piston chamber 22g and open piston chamber 22e are thereby hydraulically interconnected. In like manner, a transverse cylinder assembly passage 20f is preferably provided internally of plate 24b whereby, for purposes to be hereinafter described, close piston chamber 20e and open piston chamber 20g are thereby hydraulically interconnected.

Still referring to FIG. 2, construction of the pistons 20 and 22 will hereinafter be described in more detail. Referring first to ram close piston 20, a piston passage 20c is located internally of the stem of the piston and extends longitudinally from the proximal threaded portion thereof to a distal point located adjacent the head of close piston 20. A transverse piston passage 20d is further disposed through the shaft of the piston 20 in a manner so as to permit hydraulic interconnection between piston passage 20c and the hereinbefore described close piston chamber 20e. Internal of the wall of housing 11 extending in the same general direction as the piston passage 20c there will be seen a housing fluid passage 20b and a closing port 20a interconnected thereto having internally threaded portions thereof or other appropriate means well known in the art for providing hydraulic coupling to a source of hydraulic pressure external to the housing 11. It will further be noted that this housing fluid passage 20b is constructed so as to be in communication with piston passage 20c.

In like manner, closer inspection of open piston 22 of FIG. 2 reveals that it is also provided with a piston passage 22c extending longitudinally along and internal to the stem thereof from the proximal threaded portion to the distal piston head disposed within open cylinder 22j. However, a comparison of the distal portions of close piston 20 and open piston 22 will reveal that whereas the piston passage 20c of close piston 20 does not extend through the piston head of close piston 20, the piston passage 22c of open piston 22 extends entirely through the length of piston 22 including the head portion and moreover has not been provided with a transverse piston passage such as piston passage 20d of close piston 20. However, in like manner to close piston 20, a housing fluid passage 22b is provided internally of the wall of housing 11 and extending in the same general direction as piston passage 22c, said passage 22b being provided with an opening port 22a in communication therewith and extending to the outer surface of housing 11. This opening port 22a, in like manner to closing port 20a, may preferably be provided with internal threading or other hydraulic coupling means adapted for interconnection with a source of hydraulic pressure external to the housing 11. Thus, the arrangement of passageways associated with open piston 22 provides a hydraulic passageway, for purposes to be hereinafter described, from opening port 22a along fluid passage 22b through piston passage 22c of open piston 22 to open piston chamber 22e of open piston cylinder 22j.

Figure 3:
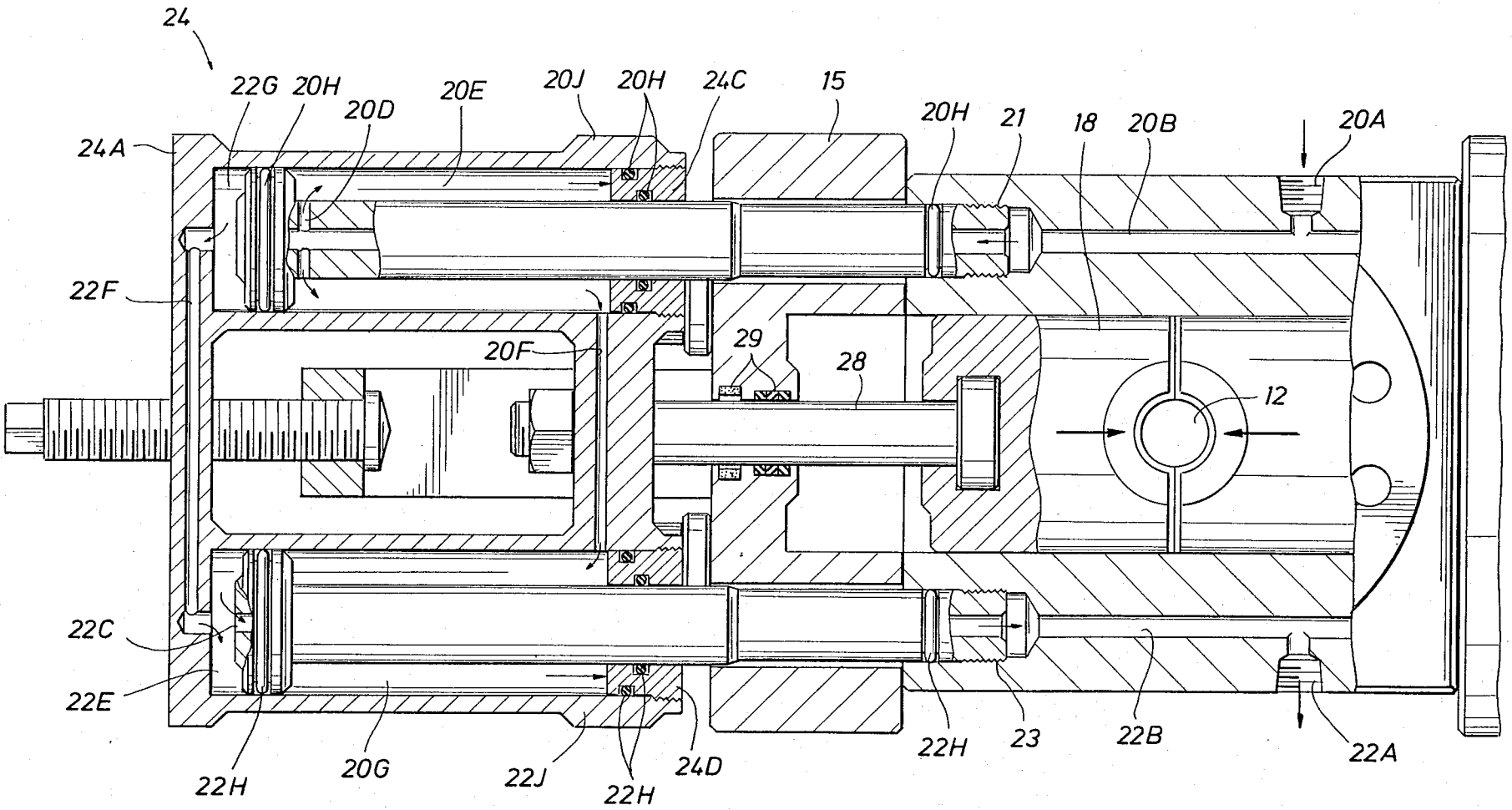
FIG. 3 is an enlarged scale plan view of the left hand portion of the valve apparatus of the present invention depicted in FIG. 1 taken along line 1—1 with the hydraulic circuit during closing of the rams being indicated by arrows.

After having thus described the passageways and chambers provided in cylinder assembly 24, the pistons 20 and 22, and housing 11, operation of the valve assembly 10 may now be described. Referring to FIG. 3, the arrows therein indicate the hydraulic circuit flow during the respective inward movement of ram bodies 18 inward toward the bore 12 for purposes of effecting sealing engagement of the inner seals 19. A suitable source of pressurized hydraulic fluid is introduced into closing port 20a. Hydraulic pressure is thereby transmitted therefrom along housing fluid passage 20b through piston passage 20c, transverse piston passage 20d and into close piston chamber 20e. Moreover, due to the transverse cylinder assembly passage 20f interconnecting close piston chamber 20e and open piston chamber 20g, this pressure from closing port 20a is also transmitted from close piston chamber 20e through transverse passage 20f and into open piston chamber 20g. The continued pressurization of close and open piston chambers 20e and 20g, respectively, will force the cylinder assembly 24 to move radially inward toward the bore 12. Due to the previously described interconnection between ram body 18 and cylinder assembly 24 by means of main stem 28, each ram body 18 associated with its respective cylinder assembly 24 is thereby moved inward of the bore 12 by the inward movement of its cylinder 24.

It will be appreciated that as the chambers 20e and 20g are thereby increasing in size from the inward movement of cylinder assembly 24 with respect to pistons 20 and 22, chambers 22g and 22e are thereby decreasing in size by a correlative amount. It should be further noted that these chambers 22g and 22e are, in like manner to chambers 20e and 20g, charged with hydraulic fluid and that means must thereby be provided for discharging this fluid in order to permit the aforementioned inward movement of the cylinder assembly 24. Due to the previously described arrangement of passages and chambers, such evacuation of hydraulic fluid is thereby made possible.

More particularly, as the plate 24a approaches the piston heads of pistons 20 and 22, hydraulic fluid in piston chamber 22g is transferred to transverse cylinder assembly passage 22f into open piston chamber 22e. As this chamber 22e is, in like manner to chamber 22g made increasingly smaller by the inward movement of cylinder 24, the hydraulic fluid therein is expelled through and along piston passage 22c, housing fluid passage 22b and out opening port 22a into an appropriate reservoir.

When it is desired to effect movement of the ram bodies 18 radially outward of the bore 12, the procedure which follows is effected. In like manner to the closing of ram bodies 18 by charging of closing port 20a, an appropriate source of hydraulic pressurized fluid is introduced into opening port 22a. Pressure is thereby transmitted down fluid passage 22b, piston passage 22c, and into piston chamber 22e. Due to provision of the transverse cylinder assembly passage 22f, this pressure is transmitted from piston chamber 22e through transverse passage 22*f* in plate 24*a* and into chamber 22*g*. As continued hydraulic pressure in chambers 22*e* and 22*g* is applied relative to that in chambers 20*e* and 20*g*, it may be seen that the cylinder assembly 24 is thereby forced radially outward of the bore 12. Such movement will continue until the ram body 18 abuttingly engages the intermediate flange 15.

In like manner to the closing operation of the ram bodies 18, means must be provided for evacuating fluid residing in the chambers 20*e* and 20*g* as these chambers decrease in size during outward movement of cylinder assembly 24. As the cylinder assembly 24 continues its outward movement, thereby decreasing the size of chambers 20*e* and 20*g*, fluid in chamber 20*g* is transferred through transverse cylinder assembly passage 20*f* into chamber 20*e*. This fluid, in turn, is thus transmitted through transverse piston passage 20*d* and along piston passage 20*c*, through housing fluid passage 20*b*, and out closing port 20*a*.

A plurality of seals 20*h* and 22*h* may be provided for isolating chambers 22*g* and 22*e* from corresponding chambers 20*e* and 20*g*, as well as for providing sealing between the pistons 20 and 22, respective chamber plugs 24*c* and 24*d*, and their corresponding cylinders 20*j* and 22*j*. Sealing engagement between pistons 20 and 22 and the housing 11 at locations adjacent respective piston support apertures 21 and 23 is provided by corresponding additional seals 20*h* and 22*h*.

It will be recalled that stem seals 29 are also disposed within intermediate flange 15 and about main stem 28, the purpose of which is to prevent flow of pressurized fluid within the bore 12 which travels past the various seals carried by ram body 18 from escaping along the main stem 28. Moreover, it will further be recalled that due to the construction of bonnets, operating cylinders, and the like of the prior art, typically an operating cylinder and piston were interconnected with main stem 28 such that upon leakage of bore fluid past the stem seals 24, fluid within the bore 12 would thereby be permitted to contaminate the hydraulic fluid associate with the operating cylinder and piston. Moreover, it was further common practice in the prior art to provide additional cylinders operating on the same hydraulic circuit as that of the main operating cylinder and piston for extracting the ram bodies 18 from the housing 11 for servicing and the like, whereby such contamination of the main operating cylinder fluid by borehole fluid would further contaminate the hydraulic fluid and operating circuit associated with these auxiliary cylinders.

It will thus be appreciated from a review of the disclosure hereinabove set forth and the accompanying drawings that in accordance with the present invention the hydraulic circuit associated with the cylinder and piston means for imparting motive force to the ram bodies 18 has been completely isolated from any pressurized fluid within bore 12. More specifically, in accordance with an important feature of the present invention, any leakage of fluid within the bore 12 about the ram bodies 18 and along main stem 28 (due to failure of stem seals 29 or the like), will be vented to the ambient and not to the operative hydraulic circuit.

In addition to contamination of hydraulic fluid experienced in the prior art, yet another serious problem associated with prior devices is avoided, namely the accidental opening of the bore 12 and outward movement of the ram bodies 18 caused by such leakage. More particularly, the leakage of pressurized fluid within the bore 12 along the main stem 29 and into the operative hydraulic circuits employed to move the ram bodies 18 would often inadvertently act as the pressurized hydraulic fluid typically introduced into the opening port, whereby such leaking of fluid from within the bore 12 into the hydraulic ram operating circuit served to move the ram bodies 18 outward. This, in turn, frequently resulted in a serious condition wherein control of pressure within the bore 12 was rendered impossible, in turn resulting in loss of control of an oil well or the like. Thus, with the teachings of the subject invention, these problems have been avoided and a means has been provided for completely isolating the pressure within bore 12 from the hydraulic circuit means for operating the ram bodies 18.

As hereinbefore described, it is frequently desirable to obtain access to the ram bodies 18 for purposes of replacing inner seals 19, for servicing ram bodies 18, or, in some instances, for replacing ram bodies 18 with those of a different shape for different purposes.

Under normal operating conditions of ram opening and closing, the distance of travel of a particular ram body 18 in the general direction of cylinder assembly line 2 is that from its position when its inner seal 19 is disposed within bore 12 (effecting sealing engagement with pipe, tubing, or the like, and the correlative and oppositely disposed inner seal 19 of the other ram body 18 on the one hand), to the position of ram body 18 when it has moved outward of the bore 12 and is in abutting engagement with its corresponding intermediate flange 15 which restrains further outward movement of the ram body 18 (so long as the bonnet bolts 16 are in place). This movement will, of course, correspond to a corresponding movement of the cylinder assembly 24 in the same general direction along and about the pistons 20 and 22 due to the interconnection between cylinder 24 and ram body 18 by means of main stem 28.

Figure 4:
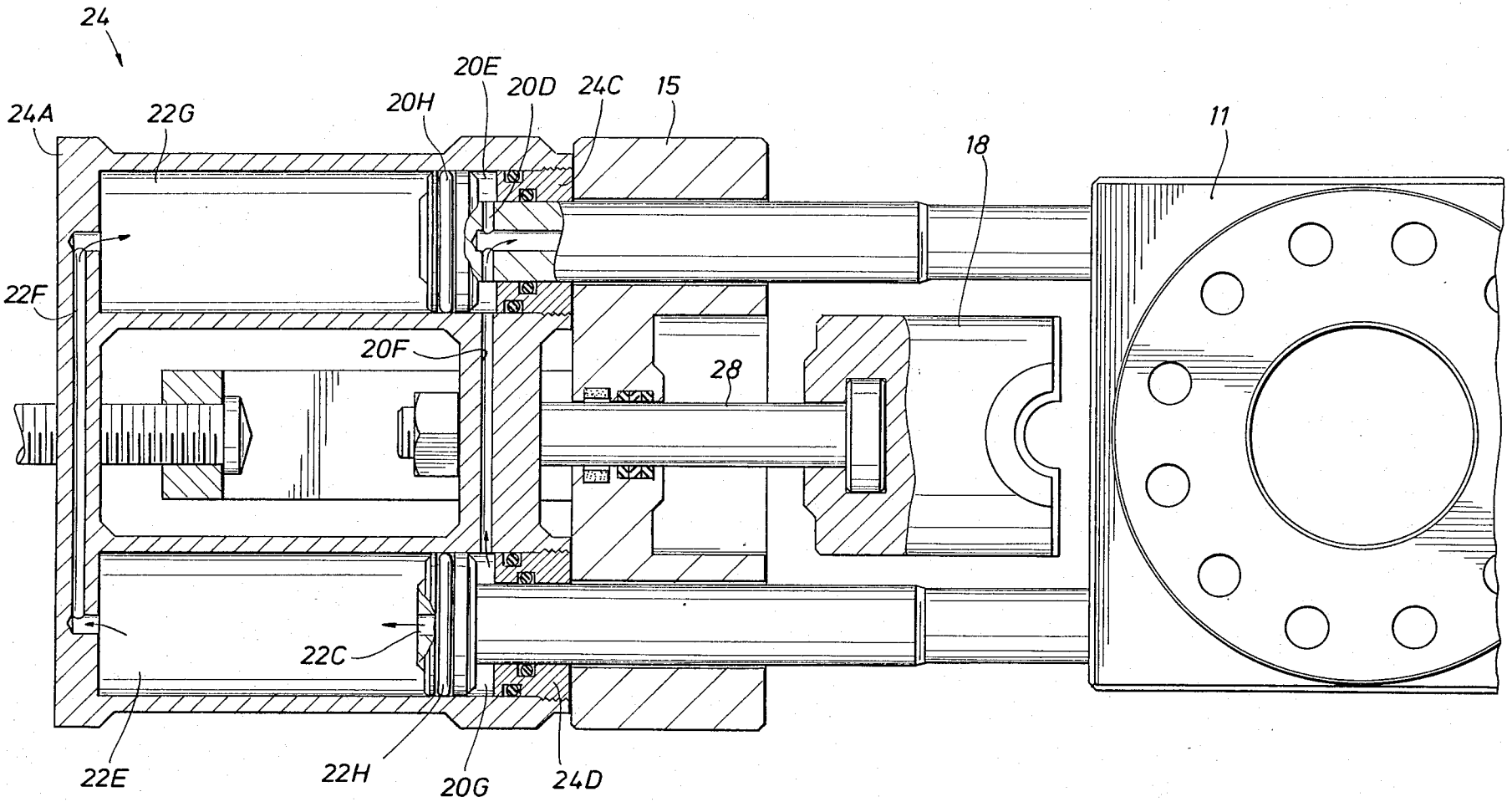
FIG. 4 is an enlarged scale plan view of the left hand portion of the valve apparatus of the present invention taken along line 1—1 with the bonnet bolts removed, and with the hydraulic circuit during extraction of the rams from the valve housing shown by arrows.

However, close inspection of FIGS. 2–4 will demonstrate that, in accordance with the teachings of the subject invention, the stroke of cylinder 24 is designed to exceed the aforementioned movement or stroke of ram body 18 during its normal opening or closing operations, the purpose of which is to provide for the removal of the ram bodies 18 from the housing 11 for servicing and the like. Referring more particularly to FIG. 2, it will thus be seen that although the ram body 18 is in abutting engagement with intermediate flange 15, but for the rigid interconnection of the flange 15 with the housing 11 by means of the bonnet bolts 16, the cylinder assembly 24 could continue further movement radially outward of the bore 12 along cylinder assembly center line 2 carrying the intermediate flange 15 and ram body 18 with it. This further movement of cylinder assembly 24, providing locking stem 36 is also manually moved radially outward by rotation of the handle, could continue until the heads of pistons 20 and 22 abuttingly engage their respective chamber plugs 24*c* and 24*d*. This operation just described is depicted in FIG. 4 wherein bonnet bolts 16 have been removed, and open port 22*a* has been hydraulically charged. Thus, it will be seen that such abutting engagement is about to occur, and that the ram bodies 18 are fully extracted from the housing 11 and thus readily accessible for servicing or change out.

It will thus be readily appreciated that a valve assembly has been provided having a new and improved means for imparting motion to the rams during normal sealing and unsealing operation and for effecting further extraction of the rams from the valve housing for ram changes, servicing, and the like.

More particularly, hydraulic means has been provided for effecting such movement and extraction wherein the hydraulic circuit therefor has been isolated from fluids and pressure within the valve bore, and wherein one of the three cylinder-piston assemblies typically employed has been eliminated, the two remaining such assemblies providing dual functions of normal sealing and unsealing movement of the rams as well as extraction thereof from the valve housing.

It is therefore apparent that the present invention is one well adapted to obtain all of the advantages and features hereinabove set forth, together with other advantages which will become obvious and apparent from a description of the apparatus itself. It will be understood that certain combinations and subcombinations are of utility and may be employed without reference to other features and sub-combinations. Moreover, the foregoing disclosure and description of the invention is only illustrative and explanatory thereof, and the invention admits of various changes in the size, shape and material composition of its components, as well as in the details of the illustrated construction, without departing from the scope and spirit thereof.

What is claimed is:

1. In a ram-type valve apparatus having a housing, a central bore therethrough, a ram guideway transverse to said bore, and a ram slidably movable along said guideway, improved means for moving said ram along said guideway comprising a piston support extending outward of and interconnected to said ram;

pressure-responsive cylinder assembly means slidable along said support for providing relative motion between said support and said pressure-responsive means in response to said pressure; and stem means for transmitting said relative motion to said ram, said motion including a first motion urging said ram inward and sealing off said bore; and a second motion urging said ram between locations within said guideway and at least partially outward of said guideway and said bore; and said pressure-responsive cylinder assembly means including an inner cylinder assembly plate rigidly interconnected to said stem means whereby said pressure-responsive means is immovable with respect to said ram during said first and second movements.

2. The apparatus of claim 1, further including first and second hydraulic circuit means disposed at least partially internal of said housing and said support for communicating hydraulic pressure to said pressure responsive means during said first and second movements, respectively.

3. The apparatus of claim 2, wherein said piston means includes a close piston having a close piston head; an open piston having an open piston head;

said cylinder assembly means includes a close cylinder and an open cylinder, said close piston head and open piston head being disposable within respective said close cylinder and said open cylinder to define, respectively, a distal and proximal close piston chamber in said close cylinder and a distal and proximal open piston chamber in said open cylinder, said cylinder assembly further including a first transverse cylinder assembly passage connecting said distal close piston chamber and said distal open piston chamber, and a second transverse cylinder assembly passage connecting said proximal close piston chamber and said proximal open piston chamber.

4. In a valve of the ram-type having a housing with a central bore therethrough, a ram guideway transverse to said bore, and a ram slidable along said guideway, improved means for moving said ram comprising:

piston support means interconnected to said housing;

pressure-responsive cylinder means carried by and slidably movable relative to said support means and including an inner cylinder assembly plate rigidly interconnected to said ram whereby said pressure-responsive means is immovable with respect to said ram, said pressure-responsive means being for urging said ram toward said bore to reduce fluid flow therethrough; and away from said bore and at least partially out of said guideway in response to said pressure.

5. The apparatus of claim 4, wherein said support means, said pressure responsive means, and said housing define hydraulic circuit means internal thereof for providing said pressure to said pressure responsive means, and said rigid interconnection between said pressure responsive means and said ram is provided by stem means, said stem means being external to said hydraulic circuit means.

6. For a ram-type blowout preventer having a housing with a central bore therethrough, a ram guideway extending theough said housing transverse to said bore, a ram slidably movable between first positions within said guideway and between one of said first positions and a second position at least partially outward of said guideway, a flange releasably attachable to said housing for preventing movement of said ram outward of said guideway, a piston carried by and extending outward from said housing, an improved means for moving said ram comprising:

a cylinder; and an inner cylinder assembly plate rigidly interconnected between said cylinder and said ram, said cylinder being disposed about and slidable along said piston and having a first stroke relative to said piston for moving said ram between said first positions when said flange is attached to said housing and a second stroke relative to said piston for moving said ram between said one of said first positions and said second position when said flange is released from said housing.

7. The apparatus of claim 5, further including:

a second piston carried by and extending outward of said housing in the general direction of said first-mentioned piston;

a second cylinder interconnected to said ram and disposed about and slidable along said second piston having a first stroke relative to said second piston for moving said ram between said first positions when said flange is attached to said housing and a second stroke relative to said second piston for moving said ram between said one of said first positions and said second position when said flange is released from said housing;

means for rigidly interconnecting said first mentioned and said second cylinder to provide coordinated movement of said cylinders along respective said first mentioned and said second pistons; and means for hydraulically interconnecting interiors of said first mentioned and said second cylinder at their distal and proximal ends.

8. The apparatus of claim 7, wherein said hydraulic interconnection means are disposed internal of said means for interconnecting said first mentioned and said second cylinders.

9. The apparatus of claim 8, further including:

a main stem rigidly interconnecting said ram with said means for interconnecting said first mentioned and said second cylinders whereby said ram is immovable relative to said means for interconnecting said first and second cylinders in the direction of said ram movement.

10. The apparatus of claim 9, wherein said means for interconnecting said first mentioned and said second cylinders comprises:

a distal outer cylinder assembly plate interconnecting said first mentioned and said second cylinder at their distal ends;

a proximal inner cylinder assembly plate interconnecting said first mentioned and said second cylinder at their proximal ends; and wherein said hydraulic interconnection means comprises a first transverse passage internal of said distal plate communicating with said interiors of said first mentioned and said second cylinders; and a second transverse passage internal of said proximal plate communicating with said interiors of said first mentioned and said second cylinders.

11. The apparatus of claim 10, wherein said main stem includes an outer surface means exposed to the ambient for preventing transmission of pressure within said bore into said interiors of said first mentioned cylinder, said second cylinder, and said hydraulic interconnection means when said flange is attached to said housing.

12. The apparatus of claim 6, wherein said movement of said ram between said first positions is between a first location of said ram in said guideway when said ram abuttingly engages said flange and a second location when said ram is at least partially sealing off said bore, and wherein said movement of said ram between said one of said first positions and said at least one second position is between said first location of said ram when said ram abuttingly engages said flange and a third location wherein at least a portion of said ram is disposed outside of said guideway and said bore.

13. The apparatus of claim 10, wherein said main stem has an outer surface portion exposed to the ambient when said flange is attached to said housing.

* * * * *